US006139768A

United States Patent [19]

Urso et al.

[11] Patent Number: 6,139,768

[45] Date of Patent: Oct. 31, 2000

[54] NITROGENATED EVAPORABLE GETTER DEVICES WITH HIGH FRITTING RESISTANCE AND PROCESS FOR THEIR PRODUCTION

[75] Inventors: Giuseppe Urso, Seregno; Daniele Martelli; Corrado Carretti, both of Milan; Plinio Innocenzi, Verona; Massimo Guglielmi; Alessandro Martucci, both of Padua, all of Italy

[73] Assignee: Saes Getters S.p.A., Lainate, Italy

[21] Appl. No.: 09/219,526

[22] Filed: Dec. 23, 1998

[30] Foreign Application Priority Data

Jan. 13, 1998 [IT] Italy ..... MI98A0032

[51] Int. Cl.[7] ..... H01J 7/18

[52] U.S. Cl. ..... 252/181.4; 252/181.6; 252/181.7

[58] Field of Search ..... 252/181.2, 181.5, 252/181.6, 181.4, 181.7

[56] References Cited

U.S. PATENT DOCUMENTS

| | | | |
|---|---|---|---|
| 3,768,884 | 10/1973 | Della Porta et al. | 316/25 |
| 3,973,816 | 8/1976 | Van Bakel et al. | 316/25 |
| 4,077,899 | 3/1978 | van Gils | 252/181.4 |
| 4,127,361 | 11/1978 | Hellier et al. | 417/48 |
| 4,203,860 | 5/1980 | Ishise | 252/181.2 |
| 4,323,818 | 4/1982 | Madden et al. | 313/481 |
| 4,342,662 | 8/1982 | Kimura et al. | 252/181.4 |
| 4,406,972 | 9/1983 | Fransen | 313/481 |
| 4,407,657 | 10/1983 | Fransen | 313/551 |
| 4,481,441 | 11/1984 | Van Gils | 313/481 |
| 4,486,686 | 12/1984 | della Porta | 313/481 |
| 4,504,765 | 3/1985 | della Porta | 313/481 |
| 4,642,516 | 2/1987 | Ward et al. | 313/481 |
| 4,961,040 | 10/1990 | della Porta et al. | 313/561 |
| 5,118,988 | 6/1992 | della Porta | 313/546 |

FOREIGN PATENT DOCUMENTS

| | | |
|---|---|---|
| 0226244 | 6/1987 | European Pat. Off. . |
| 0853328 | 12/1997 | European Pat. Off. . |
| 2351495 | 5/1977 | France . |
| 26185 | 2/1990 | Japan . |
| 26185 | 7/1990 | Japan . |

OTHER PUBLICATIONS

*Patent Abstracts of Japan,* vol. 015., No. 250 (E–1082), Jun. 26, 1991 & JP 03 078928 A, Apr. 4, 1991, abstract.

*Patent Abstract of Japan,* vol. 003., No. 132 (E–149), Nov. 6, 1979 & JP 54 111751 A, Sep. 1, 1979, abstract.

*Primary Examiner*—Joseph D. Anthony

*Attorney, Agent, or Firm*—Antton & Associates, P.C.

[57] ABSTRACT

Nitrogenated evaporable getter devices are disclosed which are resistant to the fritting conditions of the production processes of kinescopes for times of about five hours. A process is also disclosed for the production of these devices. The nitrogenated evaporable getter material comprises: 1) $BaAl_4$ powder, 2) nickel powder, and 3) iron nitride and/or germanium nitride particles that have been coated with a thin vitreous layer of boron oxide and silicon oxide, formed through a sol-gel process employing a starting solution wherein the atomic ratio between boron and silicon ranges from about 4:1 to 0.75:1.

5 Claims, 2 Drawing Sheets

NITROGENATED EVAPORABLE GETTER DEVICES WITH HIGH FRITTING RESISTANCE AND PROCESS FOR THEIR PRODUCTION

BACKGROUND AND SUMMARY OF THE INVENTION

The present invention relates to nitrogenated evaporable getter devices with high fritting resistance and to a process for their production.

It is known to use evaporable getter devices to maintain a vacuum inside kinescopes of the type that are used as the CRT of a television set and as the monitor of a computer screen. Evaporable getter devices are also being developed for use in flat panel display screens.

The evaporable getter devices that are used in kinescopes comprise a thin layer of barium that is deposited onto an inner wall of the kinescopes. The barium layer is active in gas sorption.

Evaporable getter devices are generally formed from an open metal container that contains a barium and aluminum compound ($BaAl_4$) in the form of a powder and nickel (Ni) in the form of a powder in a weight ratio of about 1:1. Once the kinescope has been evacuated and sealed, the barium is evaporated by induction-heating the evaporable getter device using a coil arranged outside the kinescope. This activation process is commonly known as "flash" activation. The following reaction takes place when the temperature of the powders reaches a value of about 800° C.:

$$BaAl_4+4Ni \rightarrow Ba+4NiAl \quad (I)$$

This reaction is strongly exothermic. The temperature of powders reaches about 1200° C., the barium that is released evaporates and is deposited by sublimation onto the walls of the kinescope.

It is known to obtain better barium films by having a small partial pressure of gas during the "flash" operation. Nitrogen gas is generally used to provide the partial pressure. These conditions encourage the evaporated barium to be homogeneously spread in all directions such that the resulting thin layer of metal has a more uniform thickness and a larger surface area.

Evaporable getter devices can contain small amounts of a nitrogenated compound in addition to $BaAl_4$ and Ni. Getter devices of this type are indicated as "nitrogenated". These nitrogenated getter devices release a small amount of nitrogen during the "flash" operation. The thin layer of barium resorbs the nitrogen within a few seconds. Compounds that are commonly used in nitrogenated getter devices include iron nitride ($Fe_4N$), germanium nitride ($Ge_3N_4$) or mixtures thereof.

Producing kinescopes, both conventional CRT types as well as for flat panel displays, involves welding two glass members in a "fritting" operation. This process involves forming a paste of glass that is molten or softened between the two members in presence of air. The glass paste has a melting point of about 450° C.

The evaporable getter device can be introduced into a conventional CRT-type kinescope after the fritting through the neck intended for housing of the electron gun. However, the diameter of the neck limits size of the getter device such that accurately positioning the evaporable getter device in the kinescope becomes difficult. For flat panel display screens, it is almost impossible to introduce the evaporable getter device after the fritting operation. Thus, kinescope manufacturers need to be able to introduce the evaporable getter device before the fritting operation.

The fritting operation simultaneously, but indirectly, exposes the evaporable getter device to heat, to atmospheric gases and to vapors that are discharged by the low-melting glass paste. These conditions cause a superficial oxidization of the components of the evaporable getter device. The extent of this oxidization depends on the specific compound. This oxidation results in a strongly exothermic reaction during the "flash" operation that is difficult to control. This reaction may result in the powder packet being uplifted, in fragments thereof being ejected, or in the container being partially melted. Any of these undesirable effects can interfere with the proper functioning of the getter device and compromise the operation of the kinescope. Furthermore, the partial oxidization of the getter during the fritting operation can cause the nitrogenated compound to undergo a partial loss of nitrogen.

Evaporable getter devices that resist partial oxidization during the fritting operation without, or that do not exhibit, the aforementioned disadvantages, are called "frittable".

The fritting operation generally lasts between one and two hours. Evaporable getter devices that are frittable under these conditions are known.

For example, U.S. Pat. No. 4,077,899 discloses non-nitrogenated evaporable getter devices that are made frittable by using nickel powders that have a particle size ranging from 30 to 65 $\mu$m, rather than the smaller particle size, generally smaller than 20 $\mu$m, generally used for non-frittable evaporable getter devices.

U.S. Pat. No. 4,127,361, which is assigned to the assignee of the present application, discloses getter devices that are made frittable using a protecting layer of organosilanes. This coating reduces the extent to which the nickel is oxidized, and may also limit the oxidation of $Fe_4N$. Accordingly, the aforementioned problems are eliminated during barium evaporation. However, it has been found that the coating process required by this method is too slow to be compatible with the industrial production.

French Patent No. 2,351,495 discloses coating the whole getter device with a thin layer of silicon oxide obtained by hydrolysis of an organic silicate. However, the resulting layer of silicon oxide is porous and, though reducing it, does not avoid the nickel oxidation. This limitation has disadvantages even for fritting times of less than two hours.

U.S. Pat. No. 4,342,662 discloses getter devices protected by a thin vitreous layer of a boron compound selected among boron oxide and boric acids, possibly further containing silicon oxide in an amount not greater than 7% by weight. These devices withstand the fritting at 450° C. for a time up to two hours.

Finally, Japanese laid-open Patent No. Hei-2-6185 discloses the protection at least of the nickel by means of a protecting layer made of boron oxide only.

However, in some cases, irregularities in the production cycle of kinescopes may result in fritting times lasting up to about five hours, either as continuous steps or as sum of the times from consecutive fritting steps. Known nitrogenated evaporable getter devices are not capable of withstanding fritting for so long.

SUMMARY OF THE INVENTION

The object of the present invention is to provide nitrogenated evaporable getter devices with a high fritting resistance, as well as to provide a process for producing the devices.

These objects are achieved according to the present invention which, in its first aspect, relates to getter devices comprising an open metal container wherein there is a mixture of a $BaAl_4$ powder having a particle size smaller than 250 μm, a nickel powder having at least 80% by weight, a particle size in the range from 10 to 60 μm, with the rest of the particles consisting of powders having a particle size smaller than 10 μm, and a third component, in form of powders having a particle size smaller than 125 μm, consisting of discrete particles comprising particles of a nitrogenated compound selected from the group consisting of iron nitride ($Fe_4N$), germanium nitride ($Ge_3N_4$) or mixed nitrides of iron and germanium, the grains of the nitrogenated compound being coated by a thin vitreous layer of boron oxide ($B_2O_3$) and silicon oxide ($SiO_2$), formed through a sol-gel process employing a starting solution wherein the atomic ratio between boron and silicon ranges from about 4:1 to 0.75:1.

As stated above, it is known to make nitrogenated evaporable getter devices frittable by coating at least the nickel with a protecting layer if not the entire powder packet. Furthermore, it is known to use vitreous protective layers consisting only of boron oxide ($B_2O_3$), only of silicon oxide ($SiO_2$) or of mixed compositions of these compounds wherein the $SiO_2$ amount was not greater than about 7% by weight.

However, an unexpected result has been found in coating only the grains of the nitrogenated compound with a layer of a $B_2O_3/SiO_2$ mixed oxide. When the mixed oxide layer is obtained through a sol-gel process employing a starting solution wherein the atomic ratio between boron and silicon ranges from about 4:1 to 0.75:1, it is possible to obtain nitrogenated evaporable getter devices that are frittable. Furthermore, the evaporable getter devices thus obtained are resistant to fritting for a longer time, and in particular for frittering times of at least five hours.

The present invention also contemplates using nickel having a particular particle size, wherein at least 80% by weight of the nickel powder has a particle size ranging from 10 to 60 μm and the rest of the powder may comprise fine powders having a particle size smaller than 10 μm.

DETAILED DESCRIPTION

Figure 1:
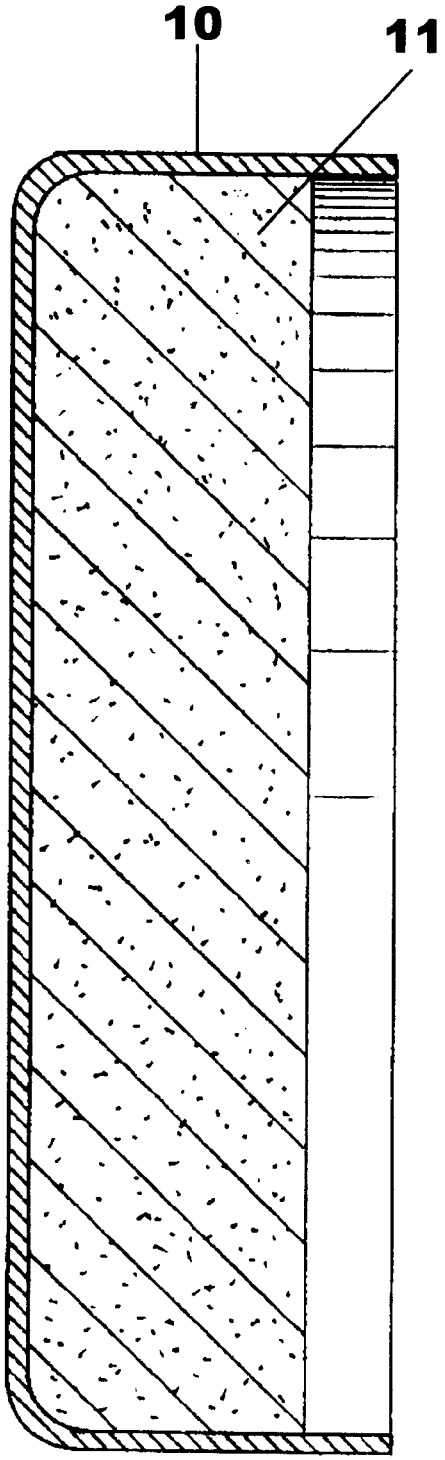
FIG. 1 shows a nitrogenated evaporable getter device of the present invention.

FIG. 1 shows a nitrogenated evaporable getter device of the present invention. The getter devices according to the invention may use any metal container known in the field; for the description of some possible shapes and of the constitutive materials of the container, U.S. Pat. Nos. 4,127,361, 4,323,818, 4,486,686, 4,504,765, 4,642,516, 4,961,040 and 5,118,988, all of which are hereby incorporated by reference.

The container 10 holds a mixture 11 that comprises powders of $BaAl_4$, nickel and coated nitrogenated compound. The weight ratio between $BaAl_4$ and Ni generally ranges from 45:55 to 55:45, while the percent weight of the nitrogenated compound generally ranges from 0.5% to 2.5% of the total weight of the powder mixture.

Figure 2:
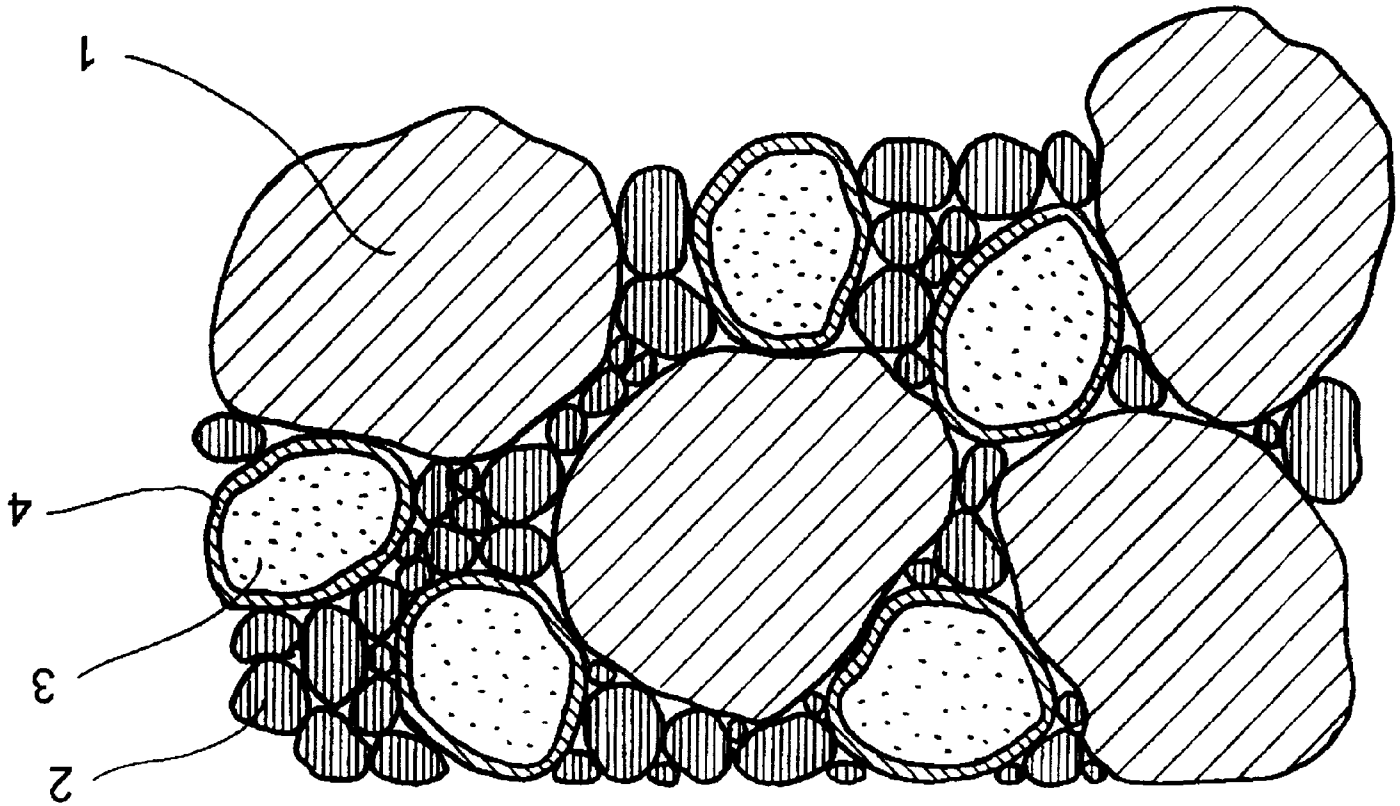
FIG. 2 shows detail of the particles of the materials comprising the nitroginated evaporable getter device shown in FIG. 1.

Referring to FIG. 2, the particles of $BaAl_4$ 1 in the powder have a size smaller than 250 μm. The particles of nickel 2 in the powder preferably have a particle size ranging from 30 to 50 μm. The particles of the powder also comprise a third component 3 comprising particles of a nitrogenated compound that are coated with a coating 4. These coated nitrogenated particles have a particle size smaller than about 125 μm.

The particles of coated nitrogenated compound 3 are produced from particles of a nitrogenated compound that have a size smaller than 30 μm, and preferably smaller than 15 μm. The coating 4 on the particles of the nitrogenated compound 3 comprises a thin vitreous layer of a $B_2O_3/SiO_2$ mixed oxide. The present invention also involves a process for producing nitrogenated evaporable getter devices with a high fritting resistance. The process according to the invention comprises:

A) coating the grains of a nitrogenated compound selected from among the group consisting of iron nitride ($Fe_4N$), germanium nitride ($Ge_3N_4$) or mixed nitrides of iron and germanium having a particle size smaller than 30 μm, and preferably smaller than 15 μm, with a thin vitreous layer of a composition formed from a mix of $B_2O_3$ and $SiO_2$, so as to obtain a powder of discrete coated particles having a particle size smaller than 125 μm;

B) mixing the powder of the particles thus obtained with (1) a $BaAl_4$ powder having a particle size smaller than 250 μm, and (2) a nickel powder, at least 80% by weight of which has a particle size ranging from 10 to 60 μm, the rest consisting of powders having a particle size smaller than 10 μm; and C) introducing the powder mixture thus obtained into an open container and compressing it inside the container by means of a suitably shaped punch.

The powders of the aforementioned nitrogenated compounds, as well as the powders of the $BaAl_4$ compound and of Ni, are commercially available, whereas the powder of the nitrogenated compound that are coated by the protective vitreous layer is not commercially available.

Coating the powders of the nitrogenated compound with the vitreous layer referred to in step A) can be accomplished as follows:

a) the grains of the dry nitrogenated compound are placed in a container;

b) the grains of nitrogenated compound are added, under continuous stirring, with an alcoholic or hydroalcoholic solution containing forerunners of the boron oxide and of the silicon oxide, thus obtaining a wet slurry of the nitrogenated compound;

c) the stirring is continued at room temperature until dry particles are obtained (a step requiring about 15 minutes);

d) a mild grinding, at a temperature between room temperature and about 100° C., is carried out on the dry particles obtained in the previous step c); and e) the particles thus obtained are sieved for collecting the fraction having a particle size smaller than 125 μm.

In the aforementioned processes, the coating of the nitrogenated compound grains in step b) is carried out with a thin liquid layer of the alcoholic or hydroalcoholic solution. Obtaining the slurry involves using a solution ranging from about 200 to 400 ml per 1 Kg of nitrogenated compound powders. A smaller solution amount does not result in a homogeneous grain coating, whereas greater amounts needlessly extends the time needed to dry the slurry.

The solvent evaporates in step c) and leaves a thin layer of boron and silicon oxides on the surface of the nitrogenated compound grains. This layer still contains small amounts of solvent and has adhesive properties such that the coated grains may form agglomerations.

Vitrification of the oxide layer happens in step d). This step has to be combined with a mild grinding in order to reduce the size of the aforementioned agglomerations and prevent the particles coated by the mixed oxide layer from having an exceedingly large size. The mild grinding can also be accomplished using a vibrating screen, wherein vibrating all the particles at the same time at least partially desegregating the aggregations of particles. The particles can then be sieved in order to collect the fraction having the desired particle size. This step can be carried out at a temperature in a range from room temperature to about 100° C.; working at the higher end of this temperature range may help to eliminate the last traces of solvent from the vitreous layer of mixed oxides. This operation may be repeated several times, e.g. from five to ten times, in order to enhance the desegregation of particle aggregations, to collect the greatest amount of product, and to favor the formation of the vitreous layer.

Finally, step e) removes the coated particles that are too small.

In order to prepare the solution, a low-molecular weight alcohol, such as methyl alcohol, ethyl alcohol or isopropyl alcohol, is generally used as the solvent.

The forerunners of the boron oxide are generally alcoholates having the general formula $B(OR)_3$, wherein the three groups —OR may be different from one another, but are preferably identical, and wherein each R is a primary, secondary or tertiary alkyl radical having a linear or branched chain of up to 5 carbon atoms; the use of boron triethylate is preferred.

As forerunners of silicon oxide, alcoholates of general formula $Si(OR)_4$ are generally used, wherein R is the same as in the boron alcoholates; the use is preferred of tetramethylate and tetraethylate of silicon, known and referred to as TMOS and TEOS, respectively.

The molar ratio between the forerunner of the boron oxide, $B(OR)_3$, and the forerunners of the silicon oxide, $Si(OR)_4$, ranges from about 4:1 and 0.75:1; preferably, this ratio ranges from about 2.1:1 and 1.75:1; more preferably, this ratio is about 2:1.

The concentration of the oxide forerunners is such that from a liter of starting solution an amount is obtained ranging from 30 to 200 grams of oxide of mixed composition. The solution is added with water, in the stechiometric amount being necessary to the hydrolysis of the forerunners according to the reactions:

$$Si(OR)_4+4H_2O \rightarrow Si(OH)_4+4ROH \quad \text{(II)}$$

$$B(OR)_3+3H_2O \rightarrow B(OH)_3+3ROH \quad \text{(III)}$$

Water is added in the form of a HCl or $HNO_3$ solution that has a concentration of $10^{-3}$–$10^{-1}$ M; the acidity of the solution favors reactions II and III.

The use is preferred of solutions wherein radicals —OR of $Si(OR)_4$ and $B(OR)_3$ compounds are identical, and corresponding to the alcohol used as solvent.

The solution may be used as soon as prepared for obtaining the mixed oxide layer, or stored for a period up to about a week. In case the solution is not used as soon as prepared, it is preferable to keep it until the use at a temperature lower than 10° C.

Once the powders of the coated nitrogenated compound are obtained, standard methods well known in the field are used for the subsequent steps of the production process of the getter devices of the invention (mixing of the powders and introduction and compression thereof into the container).

The invention will be further illustrated by the following examples. These non-limiting examples illustrate some embodiments intended to teach those skilled in the art how to work the invention and to represent the best considered way to put the invention into practice.

EXAMPLE 1

A $Fe_4N$ powder is prepared, coated with a layer of a $B_2O_3/SiO_2$ mixed oxide, using a starting solution wherein the molar ratio of boron oxide forerunner to silicon oxide forerunner is 2:1.

Fifty grams of $Fe_4N$ powder, having a particle size ranging from 8 to 15 μm, are introduced into a metal container. The powder is added, by three consecutive additions each of 5 ml, with 15 ml of a solution obtained by diluting in 1 liter of ethyl alcohol 83 g of TEOS, 114 g of boron triethylate and by adding 50.4 ml of an aqueous solution of $HNO_3$ $10^{-2}$ M. The mixture is continuously stirred for 10 minutes at room temperature. The powders thus obtained are passed through a sieve with holes having a size of 125 μm, and collected in a container kept at 100° C. The operation of sieving and collecting the powders in the heated container is repeated five times. The powders thus obtained are the protected nitrogenated compound used in some subsequent tests.

EXAMPLE 2

Ten identical getter devices are prepared using a container of the type disclosed in U.S. Pat. No. 4,961,040. A steel net is rested on the relieves of the container bottom having wires with 0.6 mm diameter and 1.54 mm meshes as disclosed in European patent application EP-0-853-328 incorporated herein by reference. Each container has 1.7 g of a powder mixture comprising 45% by weight of $BaAl_4$ having a particle size smaller than 250 μm, 52.6% by weight of nickel powder, 80% of which having a particle size ranging from 10 to 60 μm and the remaining 20% having a particle size smaller than 10 μm, and 2.4% by weight of a powder of protected nitrogenated compound obtained as described in Example 1. The samples thus obtained are subjected to a treatment of five hours in air at 450° C., simulating the conditions of an extended fritting in producing kinescopes. On the samples thus treated, the barium evaporation test is carried out according to the modalities of the standard test ASTM F 111-72, by heating the devices by induction for 40 seconds with such a level of inducing current power that the evaporation starts after 18 seconds. For all the samples, the barium evaporation does not result in uplifting of the powder packet from the container bottom or fragment detachments. The average barium yield is 330 mg.

These results show the fritting resistance of the getter devices according to the invention for a time up to five hours.

The principles, preferred embodiments and modes of operation of the present invention have been set forth in the foregoing specification. The embodiment disclosed herein should be interpreted as illustrating the present invention and not as restricting it. For instance, the deflector dimensions may vary within the aforementioned ranges, and the connection between deflector 7 and container 6 may be obtained in different ways. The foregoing disclosure is not intended to limit the range of equivalent structure available to a person of ordinary skill in the art in any way, but rather to expand the range of equivalent structures in ways not previously thought of. Numerous variations and changes can be made to the foregoing illustrative embodiments without departing from the scope and spirit of the present invention as set forth in the appended claims.

We claim:

1. A nitrogenated evaporable getter material with high fritting resistance for use in an evaporable getter device, comprising:

a $BaAl_4$ powder in which the particle size is smaller than 250 $\mu$m;

a nickel powder, having at least 80% by weight particles ranging in size from 10 to 60 $\mu$m, with most of the rest of the particles having a particle size smaller than 10 $\mu$m; and a third powder having particles with a size smaller than 125 $\mu$m comprising grains of a nitrogenated compound selected from the group consisting of iron nitride ($Fe_4N$), germanium nitride ($Ge_3N_4$) or mixed nitrides of iron and germanium, the particles being coated by a thin vitreous layer of boron oxide ($B_2O_3$) and silicon oxide ($SiO_2$), formed through a sol-gel process employing a starting solution wherein the atomic ratio between boron and silicon ranges from about 4:1 to 0.75:1.

2. A nitrogenated evaporable getter material as claimed in claim 1, wherein the weight ratio between the nitrogenated compound and the vitreous layer is in the range between 100:2 and 100:5.

3. A nitrogenated evaporable getter material as claimed in claim 1, wherein the atomic ratio between boron and silicon in the starting solution ranges from about 2.1:1 and 1.75:1.

4. A nitrogenated evaporable getter material as claimed in claim 3, wherein the atomic ratio between boron and silicon in the starting solution is about 2:1.

5. A nitrogenated evaporable getter material as claimed in claim 4, wherein the weight ratio between the nitrogenated compound and the vitreous layer is in the range between 100:2 and 100:5.

* * * * *